US006967902B1

(12) United States Patent
Klosterman

(10) Patent No.: US 6,967,902 B1
(45) Date of Patent: Nov. 22, 2005

(54) VOICE FEEDBACK TIMER SYSTEM

(75) Inventor: Wade C. Klosterman, Denver, CO (US)

(73) Assignee: WC Man Productions, Denver, CO (US)

( * ) Notice: Subject to any disclaimer, the term of this patent is extended or adjusted under 35 U.S.C. 154(b) by 602 days.

(21) Appl. No.: 09/613,514

(22) Filed: Jul. 10, 2000

Related U.S. Application Data

(60) Provisional application No. 60/143,740, filed on Jul. 14, 1999.

(51) Int. Cl.[7] ..... G04B 21/08; G04C 17/00; G04F 8/00

(52) U.S. Cl. ..... 368/63; 368/69; 368/109

(58) Field of Search ..... 368/63, 69, 72–74, 368/107–109, 250, 251; 704/272–276

(56) References Cited

U.S. PATENT DOCUMENTS 4,257,117 A 3/1981 Besson
4,270,199 A 5/1981 Sasaki et al.
4,379,640 A * 4/1983 Inoue ..... 368/63
4,432,652 A 2/1984 Munekata et al.
4,444,511 A 4/1984 Ogihara et al.
4,448,542 A * 5/1984 Washizuka et al. ..... 368/63
4,468,131 A 8/1984 Bui et al.
4,629,329 A * 12/1986 Komiyama ..... 368/10
4,632,570 A * 12/1986 Kelsey ..... 368/107
4,690,566 A * 9/1987 Robertsen ..... 368/108
4,769,797 A 9/1988 Murakami
4,775,801 A 10/1988 Baum
4,876,676 A * 10/1989 Shimizu et al. ..... 368/63
5,140,564 A 8/1992 Rich
5,233,571 A 8/1993 Wirtschafter
5,365,494 A 11/1994 Lynch
5,442,600 A * 8/1995 Kutosky ..... 368/109
5,444,673 A * 8/1995 Mathurin ..... 368/63
5,453,960 A 9/1995 Teres et al.
5,563,850 A 10/1996 Hanapole
5,742,564 A 4/1998 Kuschel et al.
5,794,205 A * 8/1998 Walters et al. ..... 704/275
5,854,774 A * 12/1998 Timme ..... 368/10

* cited by examiner

*Primary Examiner*—Vit Miska
(74) *Attorney, Agent, or Firm*—Hovey Williams LLP

(57) ABSTRACT

A portable timer with an alarm, wherein the timed period is limited to multiples of certain discrete periods of time (i.e. fifteen minutes, thirty minutes, one hour, two hours, etc.) without reference to the actual time of the day or to any specific minute or hour of the day. Thus, users need never convert to actual time the length of a period to be timed nor set the device to local time prior to use. The alarm may be set and the timing function initiated with the push of a single button. The device is further operable to provide audible feedback in the form of human speech regarding its operation and operative mode. Additionally, the device allows for the recording of a short message to be played in lieu of an alarm tone at the end of the timed period.

12 Claims, 2 Drawing Sheets

VOICE FEEDBACK TIMER SYSTEM

RELATED APPLICATIONS

This application claims the priority benefit of the provisional application entitled Voice Feedback Timer System, Ser. No. 60/143,740, filed Jul. 14, 1999, and incorporates the identified provisional application into the present application by reference.

BACKGROUND OF THE INVENTION

1. Field of the Invention

The present invention relates to timers and simple recording devices, and, more particularly, to portable timing devices that include alarms for indicating the end of a timed period, provide user feedback in the form of human speech, and allow for the recording of short messages.

2. Description of the Prior Art

People often desire to measure or limit the duration of their activities. Commonly, this involves using a timer and an alarm to measure the passing and indicate the expiration of a predefined period of time.

Relatively sophisticated apparatuses exist, such as common alarm clocks, which are able to measure periods of time with reference to the actual time of the day. Though varying in complexity, cost, and available functions, typically such apparatuses include a timekeeping function, typically comprising a clock and an associated display whereby the actual time of the day is displayed; a timer and an associated alarm; mechanisms whereby the clock and alarm may be set; and a "snooze" or delay function. Because these apparatuses inseparably combine the roles of general timekeeping and fixed period timing, users requiring only a timing function are forced to purchase, carry, program, and use the inseparable timekeeping function as well. Thus, rather than merely setting a timer, a user must convert the length of the desired timed period into an actual time of the day and then proceed to set the alarm with reference to that actual time. This may require some effort depending on the particular alarm-setting means. For example, if, at 11:52 am a user wishes to set an alarm for 12:07 pm (a fifteen minute difference), he or she at the very least would have to set the hour, the minute, and the am/pm indicator. Of course, for a number of reasons, including a power outage, time change, or travel to a different time zone, the user may first find himself or herself having to set the clock upon which the alarm is based. Depending on the means provided for setting the time and the alarm, the user may have to wait as each digit or value advances from some starting value to the desired value. Once the alarm is set relative to actual time, additional steps may be required to activate the alarm such that it will sound when the set time is reached. Because of the inefficiency of associating simple fixed period timing with actual time, such apparatuses are much too inefficient, complex, and expensive for users requiring a simple timer.

Another disadvantage of conventional timers and alarm clocks, particularly for those with vision-related disabilities, is the lack of any non-visual feedback from the apparatus indicating, for example, that the alarm has been set or cleared, or which of different types of alarms will sound when the set time has been reached. Also, conventional timers and alarm clocks are typically limited to alarms consisting of either nonsense tones or radio programming with no capability for customization.

SUMMARY OF THE INVENTION

The device of the present invention is a simple, portable timer with an alarm that operates without reference to the actual time of the day. This allows the alarm to be set and the timing function initiated simply by depressing a single button representing a discrete unit of time (i.e. one hour, fifteen minutes, etc.). As in the above example, if, at 11:52 am a user wishes to set an alarm for 12:07 pm (a fifteen minute difference), using the voice feedback timer system of the present invention, he or she could do so with a single press of the particular button corresponding to a fifteen minute period. The timer will activate automatically with no additional steps. Furthermore, because the actual time of the day is irrelevant to the timing function, use of the present invention never requires that a clock be reset. Thus, by separating the timekeeping and timing functions and limiting the length of the timed period to discrete multiples of a predetermined number of minutes or hours, the present invention allows for a less complex, less expensive, and lighter timing device which is much easier and faster to use than conventional alarm clocks. Users who frequently nap for discrete blocks of time, truckdrivers and students for example, will appreciate that the alarm may be set and the timing initiated with as little effort as the push of a single button. Travelers will appreciate the devices' light weight and lack of dependence on local time.

Another advantage of the present invention, particularly for those with vision-related disabilities, is its ability to provide auditory feedback indicating the operation or operative mode of the device, including that the alarm has been set or cleared and which of the different alarm types will sound at the end of the timed period.

The device further allows for the recording of short messages to be played at the end of the timed period in lieu of a default alarm tone. This provides the added advantage of allowing a user to remind his- or herself upon waking of an important event.

These and other important aspects of the present invention are more fully described in the section entitled DETAILED DESCRIPTION OF A PREFERRED EMBODIMENT, below.

BRIEF DESCRIPTION OF THE DRAWINGS

A preferred embodiment of the present invention is described in detail below with reference to the attached drawing figure, wherein.

DETAILED DESCRIPTION OF A PREFERRED EMBODIMENT

Figure 1:
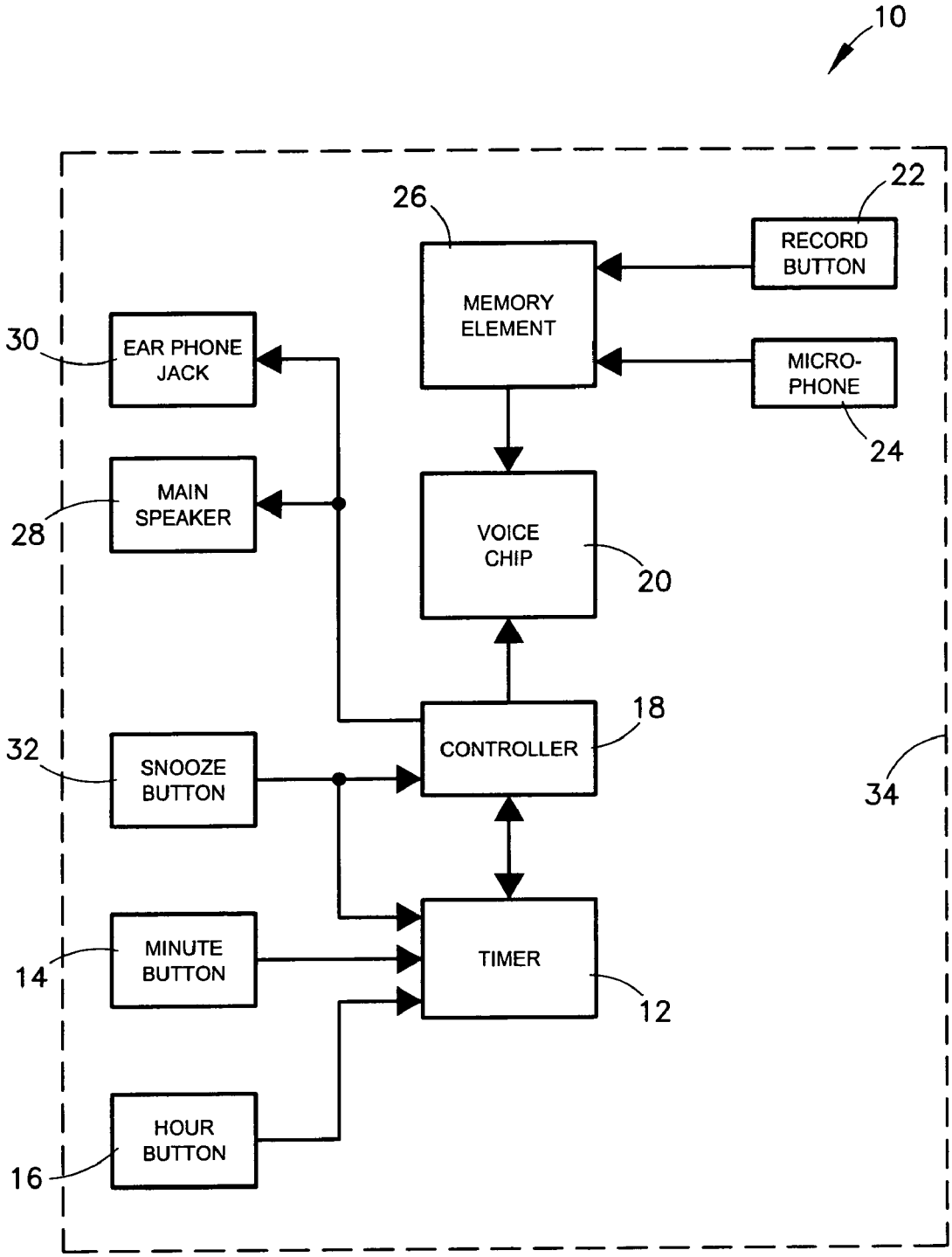
FIG. 1 is a block diagram illustrating a preferred embodiment of the present invention.
Figure 2:
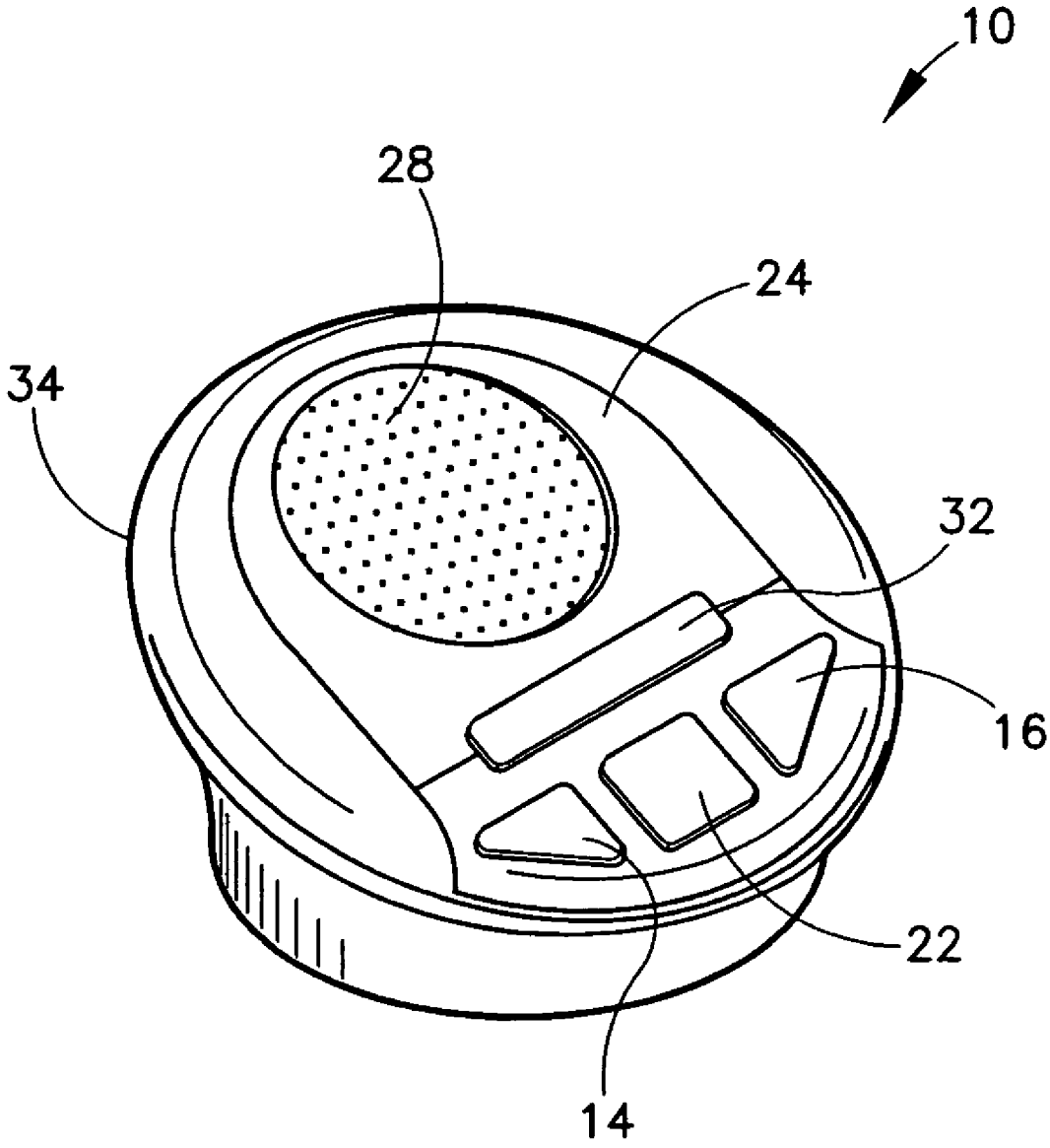
FIG. 2 is a perspective view illustrating a preferred embodiment of the present invention.

Referring to FIG. 1, a block diagram is shown which illustrates a timing device 10 which is operable to measure discrete periods of time without reference to the actual time of the day, provide audible feedback announcements in the form of human speech regarding the device's operation or operative mode, and to sound an alarm or replay recorded messages at the end of the timed period. A preferred embodiment of the device 10 is shown as having nine major components: a timer 12; a minute button 14; an hour button 16; a controller 18; a voice chip 20; a record button 22; a microphone 24; memory element 26; a speaker 28; an ear-phone jack 30; a snooze button 32; and a housing 34. Illustrated in FIG. 2 is a preferred positioning of the minute button 14, hour button 16, record button 22, microphone 24, speaker 28, and snooze button 32 relative to each other and to the housing 34. Preferably, the buttons 14,16,22,32 are of a relatively large size in order to facilitate use, labeled in order to facilitate identification, and located on the top portion of the housing 34 in order to facilitate access, all of which increases the ease and convenience of using the device 10.

Referring again to FIG. 1, the timer 12 is operable to measure the length of a desired period of time without reference to the actual time of day or to any specific hour or minute of the day. The timer 12 receives input via the minute, hour and snooze buttons 14,16,32 which determines the length of the timed period and sets the timer 12.

The minute button 14 is associated with discrete fifteen minute periods and may be depressed up to three times, each of which adds fifteen minutes to the length of the timed period, resulting in a maximum of forty-five minutes. Five seconds after the minute button 14 is activated the controller 18 will cause the device 10 to announce, via either the main speaker 28 or the ear-phone jack 30, that the "time is set", and the timer 12 will begin to run. If the minute button 14 is activated a fourth time before the "time is set" announcement, the timer 12 will clear, the device 10 will announce "clear", and no timing will occur.

The hour button 16 is associated with discrete one hour periods and may be depressed up to four times, each of which adds one hour to the length of the timed period, resulting in a maximum of four hours. Five seconds after the hour button 16 is activated, the controller 18 will cause the device 10 to announce that the "time is set", and the timer will begin to run. If the hour button 16 is activated a fifth time before the "time is set" announcement, the timer 12 will clear, the device 10 will announce "clear", and no timing will occur.

Furthermore, regardless of the number of times they have been depressed, if either the minute or hour buttons 14,16 are activated after the "time is set" announcement, then the device 10 will announce "clear", the timing in progress will be stopped, and the timer 12 will be cleared.

The controller 18 initiates the sounding of the alarm, which may consist of either the default chimes or a recorded message, when the timer 12 indicates that the timed period has expired. The controller 18 also governs the playing of feedback announcements regarding the operation or operative mode of the device 10.

The voice chip 20 allows the device 10 to produce human speech. This capability is essential for the replaying of recorded messages, and is also used in the preferred embodiment for providing feedback announcements in the form of human speech. The voice chip 20 is well-known and commonly available.

The record button 22, microphone 24 and memory element 26 combine to provide the device 10 with the capability of recording a message for future playback. When the record button 22 is depressed, the device 10 will instruct the user to "please record". At the end of such announcement, recording begins for a maximum of ten seconds or until the record button 22 is released. To record, a user simply speaks or otherwise directs a message into the microphone 24 while depressing the record button 22. A message can only be recorded if the timer 12 is cleared; thus, recordings should be made prior to setting the timer 12. Depressing the snooze button 32 within five minutes after recording will result in the recorded message being played. The recorded message is stored in the memory element 26, which is preferably of a commonly available type that does not erase when deprived of power.

Once the timer 12 has been set, the record button 22 allows the user to toggle between the two alarm modes, either the chimes or the recorded message. After setting the length of the timed period, as described above, depressing the record button 22 will cause the device 10 to announce either "chimes" or "your message", indicating which will be played as an alarm at the appropriate time. The user may select the desired alarm mode by depressing the record button 22 either once or twice until the desired alarm mode is announced by the device 10. After five seconds, the device 10 will announce that "time is set" and the timer 12 will begin to run. While the timer 12 is running, depressing the record button 24 will cause the device 10 to announce the alarm mode and the total length of the timed period.

At the end of the timed period, the controller 18 will cause either the chimes to sound or the recorded message to be played. If either the minute or hour buttons 14,16 are depressed after the alarm has begun to sound, the alarm will immediately terminate. If no action is taken, however, the alarm will terminate automatically after the chimes have repeated ten times or the recorded message has played in its entirety once, thereby minimizing power consumption and extending battery life.

The snooze button 32 allows the user with the push of a single button to stop the alarm and set the timer for seven and one-half minutes. A chime will sound indicting that the additional time was set. At the end of the seven and one-half minute delay period, the alarm, whether chimes or message, will begin again. The snooze button 32 may be depressed each time the alarm or message is activated.

Normally, all announcements and alarms are made through the speaker 28. An ear-phone jack 30 is included, however, so that the device 10 may be used without disturbing others. The jack 30 is preferably a standard 3.5 mm pin jack. The speaker 28 will be disabled while the earphones remain connected.

The present invention requires electrical power, preferably in the form of four M batteries in order to preserve the portable nature of the device 10. It is anticipated that these batteries will supply power for up to one year. The greatest power drain occurs while the speaker 28 is in use.

From the preceding description, it can be seen that voice feedback timer system of the present invention provides for a simple, small, and inexpensive timer which has the advantages of being able to provide audible feedback in the form of human speech and to record short messages.

Although the invention has been described with reference to the preferred embodiment illustrated in the attached drawings, it is noted that equivalents may be employed and substitutions made herein without departing from the scope of the invention as recited in the claims. For example, the timer 12 and controller 18 might be combined in a single chip or circuit; similarly, the voice chip 20 and memory element 26 might be combined in a single chip or circuit. Furthermore, although described for purposes of illustration as being a stand-alone device, the concepts disclosed herein may be incorporated into larger devices without departing from the scope of the original invention as recited in the claims.

In another embodiment, The device 10 includes a scan button which, when depressed, operates to cause the device 10 to audibly advance or scan through a number of choices or settings. The user selects a desired choice or setting by releasing the scan button immediately after the desired choice or setting is announced. For example, a user desiring to measure a forty minute time period would depress the appropriate scan button and then listen as the device 10 announces a progression of possible settings such as: "ten minutes . . . twenty minutes . . . thirty minutes . . . forty minutes". When the user hears "forty minutes" announced, he or she would select that setting by releasing the scan button. Five seconds later, as described above, timing would begin. The scan button could be included either in addition to or in replacement of the minute or hour buttons 14,16 of the above described invention.

In yet another embodiment, the device 10 is controlled by its user's voice. Thus, the user could activate the device 10 and make choices or settings simply by vocalizing the appropriate commands. For example, a user desiring to measure a forty minute time period and play a pre-recorded message at the end of that period would vocalize to the device 10 a command sequence similar to the following: "on . . . minutes . . . forty . . . alarm . . . message". This voice control feature could be included either in addition to or in replacement of the minute or hour buttons 14,16 of the above described embodiment.

Having thus described the preferred embodiment of the invention, what is claimed as new and desired to be protected by Letters Patent includes the following:

1. A timing device for timing discrete periods of time, the device comprising:

at least one timer operable to measure the passing of a particular period of time without reference to the actual time of the day or to any specific hour or minute of the day, the length of the particular period of time being adjustable and the adjustability being limited to multiples of a discrete number of minutes or hours;

at least one input device operable to allow for adjusting the length of the particular period of time;

a controller operable to provide feedback signals relating to the operation and operative mode of the timing device, and further operable to produce an alarm signal;

at least one speaker; and a voice chip operable to combine with the speaker and the controller to convert the feedback signals to audible human speech.

2. The device of claim 1, further comprising an ear-phone jack operable to provide a connection point for ear-phones the connection of which causes the speaker to cease operating while the ear-phones are connected.

3. The device of claim 1, the input device being a button.

4. The device of claim 1, the discrete number of minutes being fifteen minutes.

5. The device of claim 1, the discrete number of hours being one hour.

6. A timing device for timing discrete periods of time, the device comprising:

at least one timer operable to measure the passing of a particular period of time without reference to the actual time of the day or to any specific hour or minute of the day, the length of the particular period of time being adjustable and the adjustability being limited to multiples of a discrete number of minutes or hours;

at least one input device operable to allow for adjusting the length of the particular period of time;

a controller circuit operable to provide feedback signals relating to the operation and operative mode of the timing device, and further operable to produce an alarm signal;

at least one speaker;

at least one memory device operable to record and store a message for future playback; and a voice chip operable to combine with the speaker, the memory device, and the controller to convert the feedback signals and the message into audible human speech.

7. The device of claim 6, further comprising an ear-phone jack operable to provide a connection point for ear-phones the connection of which causes the speaker to cease operating while the ear-phones are connected.

8. The device of claim 6, the input device being at least one button.

9. The device of claim 6, the discrete number of minutes being fifteen minutes.

10. The device of claim 6, the discrete number of hours being one hour.

11. The device of claim 6, the device further comprising a microphone.

12. A timing device for timing discrete periods of time, the device comprising:

at least one timer operable to measure the passing of a particular period of time without reference to an actual time of a day, with the length of the particular period of time being setable and the setability being limited to multiples of two or more discrete time units, wherein the two or more discrete time units include a first discrete time unit corresponding to fifteen minutes and a second discrete time unit corresponding to one hour;

at least one input device operable to allow for setting the length of the particular period of time, wherein measurement of the particular period of time is initiated automatically following setting of the particular period of time;

a controller operable to provide feedback signals relating to the operation of and operative mode of the timing device, and further operable to produce an alarm signal;

at least one memory device operable to record and store a message for future playback;

at least one speaker operable to communicate the feedback signals, the alarm signal, and the message; and an ear-phone jack operable to connect one or more earphones to the timing device and operable to communicate the feedback signals, the alarm signal, and the message, wherein the speaker is disabled while the ear-phone jack is in use.

* * * * *